US009121135B2

(12) United States Patent
Erren et al.

(10) Patent No.: US 9,121,135 B2
(45) Date of Patent: Sep. 1, 2015

(54) USE OF SODIUM DITHIONITE IN PULPING

(71) Applicant: BASF SE, Ludwigshafen (DE)

(72) Inventors: Stefan Erren, Kallstadt (DE); Dieter Schönhaber, Meckenheim (DE); Martin Schachtl, Buch (DE)

(73) Assignee: BASF SE (DE)

( * ) Notice: Subject to any disclaimer, the term of this patent is extended or adjusted under 35 U.S.C. 154(b) by 0 days.

(21) Appl. No.: 14/103,905

(22) Filed: Dec. 12, 2013

(65) Prior Publication Data

US 2014/0158315 A1 Jun. 12, 2014

Related U.S. Application Data

(60) Provisional application No. 61/736,012, filed on Dec. 12, 2012.

(51) Int. Cl.

| | |
|---|---|
| ***D21C 3/02*** | (2006.01) |
| ***D21C 3/06*** | (2006.01) |
| ***D21C 3/04*** | (2006.01) |
| ***D21C 3/22*** | (2006.01) |

(52) U.S. Cl.
CPC .. *D21C 3/04* (2013.01); *D21C 3/02* (2013.01); *D21C 3/06* (2013.01); *D21C 3/222* (2013.01)

(58) Field of Classification Search
CPC ..... D21C 3/003; D21C 3/02; D21C 3/022; D21C 3/006; D21C 3/222
USPC ..... 162/82
See application file for complete search history.

(56) References Cited

U.S. PATENT DOCUMENTS 4,213,821 A * 7/1980 Vanderhoek et al. ..... 162/72
2012/0168102 A1 7/2012 Yoon et al.

FOREIGN PATENT DOCUMENTS

DE 912 169 C 5/1954

OTHER PUBLICATIONS

Chandra Yuspup, Alkaline Pulping:Deadload Reduction Studies in Chemical Recovery System, 2004, Georgia Institute of Technology.*
Rydholm, Sven, Pulping Processes, 1965, Interscience Publishers, p. 441-446.*
English translation of Über Den Aufschluβ Von Fichtenholz Mit Laugen Erhöhten Reduktionspotentials by George et al., 1952, English translation date: Apr. 2, 2014.*
Burillo, Kinetics of Anthraquinone Reduction with Soidum Dithionite in Alkaline Medium, 1988, AIChe Journal, vol. 34 No. 5, p. 865-869.*
Wang Yan, Pretreamnet and Enxymatic Treatment of Spruce, 2014, KTH Royal Institute of Technology, doctoral thesis.*
"Papier, Faserrohstoffe", Ullmanns Enzyklopädie der technischen Chemie, vol. 4, Issue 17, (1979), pp. 531-576.
Jayme, V.G., Wörner G., "Uber vergleichende alkalische Aufschlüsse von Fichtenholz unter Zusatz von Hypodisulfit und Sulfit", Papier, Issue 11, (1952), pp. 220-222.
Jayme, V.G., Wörner, G., "Über den Aufschluβ von Fichtenholz mit Laugen erhöhten Reduktionspotentials", Holz als Roh- und Werkstoff, vol. 10, Issue 6, (1952), pp. 244-249.
International Search Report for PCT/EP2013/075193 dated Mar. 17, 2014.

* cited by examiner

*Primary Examiner* — Anthony Calandra
(74) *Attorney, Agent, or Firm* — Drinker Biddle & Reath LLP

(57) ABSTRACT

A method of producing cellulose from lignocellulosic material by sulfite digestion or sulfate digestion in the presence of a salt of dithionous acid comprises using the salt of dithionous acid in an amount from 0.1 to 4.0 wt. % based on the amount of oven-dry lignocellulosic material.

6 Claims, No Drawings

USE OF SODIUM DITHIONITE IN PULPING

CROSS-REFERENCE TO RELATED APPLICATIONS

This application claims the benefit of U.S. Provisional Application 61/736,012, filed Dec. 12, 2012, which is incorporated herein by reference.

The present invention relates to a method of producing cellulose from lignocellulosic material by sulfite digestion or sulfate digestion, as defined in the claims.

Methods of obtaining cellulose from lignocellulosic material, such as wood, are known and described for example in Ullmanns Enzyklopädie der technischen Chemie, 4th edition, volume 17, "Paper, fibrous raw materials", pp. 531-576, Verlag Chemie Weinheim, New York (1979). Typically, cellulose is obtained from the lignocellulosic material, for example wood, by chemical processes of destructurization. Examples of such chemical methods of destructurization are sulfite digestion as used for these purposes and the similarly familiar process of sulfate digestion. Sulfite digestion and sulfate digestion are described in the above-cited Ullmann reference for example.

Put simply, lignocellulosic material is treated in the two abovementioned processes as follows to obtain cellulose.

In the sulfite process (hereinafter also called "sulfite digestion"), lignocellulosic material, typically wood, is treated with a cooking liquor in an acidic or neutral medium in the presence of sulfites (salts of sulfurous acid $H_2SO_3$), whereby the lignin is typically sulfonated and water-solubilized and thus can be removed from the fibers to leave behind the cellulose.

There are various types of the sulfite process in existence, which differ inter alia in the pH of their cooking liquor. Examples are:

a) the acidic bisulfite process with magnesium dihydrogensulfite (hereafter also "$Mg(HSO_3)_2$") and sulfur dioxide, $SO_2$, as well as water as a component of the cooking liquor, b) the bisulfite process with $Mg(HSO_3)_2$ as a component of the cooking liquor, c) the neutral-sulfite process with disodium sulfite (hereinafter also "$Na_2SO_3$") and sodium carbonate (hereinafter also "$Na_2CO_3$"), as components of the cooking liquor, and d) the alkali-sulfite process with $Na_2SO_3$ and sodium hydroxide (hereinafter also "NaOH") as well as water as components of the cooking liquor.

The acidic bisulfite process generally utilizes magnesium in the form of magnesium oxide (MgO) as a base, which is then converted to the dihydrogensulfite. Instead of magnesium (Mg), the acidic bisulfite process can also utilize calcium (Ca), sodium (Na) or ammonium ($NH_4^+$) as a base for the cooking liquor, which is then used similarly to magnesium in the form of the corresponding oxides/hydroxides. These metals except for calcium can typically also be used in similar fashion in the bisulfite process.

Of the sulfite processes, the acidic magnesium bisulfite process is currently the most frequently used.

Softwoods such as sprucewood, also firwood and the wood of the hemlock fir generally come into consideration as lignocellulose material for the sulfite process. Some hardwood species such as beech, poplar and birch are also suitable. Sprucewood is preferred for the sulfite process.

The abovementioned various types of the sulfite process typically each operate at pressures ranging from 0.1 to 10 bar and generally at certain pH ranges. The typical pH is in the range from 2 to 3 for the acidic bisulfite process a), in the range from 3 to 5 for the bisulfite process b), in the range from 6 to 9 for the neutral sulfite process c) and around 11 for the alkali-sulfite process d).

The digestion temperatures in the sulfite process differ in line with the pH range. Thus, the temperature range is generally from 120° C. to 150° C. for the acidic bisulfite process a), from 150° C. to 160° C. for the bisulfite process b) and in the range from 160° C. to 180° C. for both the sodium sulfite process c) and the alkali-sulfite process d).

The cooking liquor in the sulfite process typically comprises so-called free sulfur dioxide ($SO_2$), which is present as $SO_2$ and sulfurous acid (hereinafter also "$H_2SO_3$") and bound $SO_2$, which is bound to a cation (base). Free $SO_2$ and bound $SO_2$ are generally reported as total $SO_2$. The cooking liquor in the sulfite process generally has the following composition:

$$M_2SO_3+H_2SO_3+SO_2+H_2O,$$

of which the $H_2SO_3$ and the $SO_2$ are assigned to the free $SO_2$ and the $M_2SO_3$ to the bound $SO_2$. M here is the respective so-called base, for example magnesium.

The proportion of base and of $SO_2$ in the cooking liquor is reported in weight percent. For instance, a cooking liquor having a total $SO_2$ content of 80 g per liter comprises 8% of total $SO_2$. The base fraction is reported in the particularly corresponding oxide form for the base, such as MgO, CaO, $Na_2O$.

A cooking liquor is typically prepared via an absorption of $SO_2$ on water and base vehicles. The equation hereinbelow shall serve as an example of the principle of cooking-liquor production in the bisulfite process using magnesium as base (magnesium bisulfite).

$$Mg(OH)_2+2SO_2 \rightarrow Mg(HSO_3)_2$$

In the sulfate process (also known as "kraft digestion or "sulfate digestion" among those skilled in the art), cellulose is typically obtained from lignocellulosic material for example the wood of trees or else from annual plants, for example reed, grain (straw), sugarcane (bagasse), corn.

Typically, in the sulfate process, chips of the lignocellulosic material, for example wood or comminuted stems of plants, are heated in pressure vessels for several hours, for example 3 to 6 hours, at elevated pressure, for example in the range from 7 to 10 bar, typically in a mixture of aqueous sodium hydroxide solution (aqueous NaOH), sodium sulfide ($Na_2S$) and sodium sulfate (hereinafter also "$Na_2SO_4$") and optionally sodium carbonate (hereinafter also "$Na_2CO_3$").

This produces the so-called "black liquor" (soluble alkali metal lignin), which is separated from the cellulose by filtration.

Using the sulfite and sulfate processes mentioned, cellulose can be separated from lignin, but it continues to be desirable to increase the pulp yield and to achieve this more particularly with a simultaneously low lignin content for the pulp.

It is known, for example for the destructurization of wood into pulp, that there is a relationship between the so-called "degree of destructurization", as expressed by the "kappa number" for example, and the pulp yield.

The kappa number is a measure of the lignin content of the pulp.

A very low kappa number, i.e., a very low lignin content of the pulp, typically correlates with a low pulp yield. This is because, typically, it is not just more and more lignin which is remote with increasing destructurization, but increasingly also pulp (components) (predominantly hemicelluloses)

being dissolved out of the wood into the cooking liquor. The result is a lower quantity of isolated cellulose relative to the wood used.

One disadvantage of pulp digestion by the sulfate process is the formation of malodorants such as mercaptans, especially methyl mercaptan.

The addition of sodium dithionite (hereinafter also "$Na_2S_2O_4$") in the pulpmaking operation is known in principle from the following references.

G. Jayme and G. Wörner describe an alkaline sulfite pulping process for sprucewood at 170° C., 24 hours, wherein 100 $cm^3$ of the pulping liquor comprised 3 g of NaOH, 1.56 g of sodium dithionite ($Na_2S_2O_4$) and 4.69 g of $Na_2SO_3$(G. Jayme, G. Wörner, Papier, volume 6, No. 11, pp. 220-222 (1952)). Relatively large quantities of sodium dithionite, based on the wood to be treated, are described indirectly therein via the quantitative schedule of chemicals as well as the "liquor ratio" (page 221, left-hand column, numerical table and the subsequent paragraph).

Jayme and Wörner further describe in *Holz als Roh-and Werkstoff* 10 (1952) 6, pp. 244-249, the use of relatively large amounts of sodium dithionite ($Na_2S_2O_4$) in a sulfate liquor (65% NaOH, 25% $Na_2S$ and 10% $Na_2CO_3$) in the sulfate pulping of sprucewood. The amount of sodium dithionite, based on the wood to be treated, is also described here indirectly via the quantitative schedule of chemicals and also the "liquor ratio" (page 246, left-hand column from "Effect of sodium hypodisulfite in sulfate pulping liquors" through table 2). The 1:7.5 "liquor ratio" described therein indicates that 7.5 parts by mass of cooking liquor were used per 1 part by mass of wood.

The problem addressed by the present invention was that of obtaining a high pulp yield coupled with a simultaneously low lignin content on the part of the pulp in the digestion of lignocellulosic material while reducing the creation of malodorous emissions in the sulfate process in particular.

The problem was solved by adding small amounts of a salt of dithionous acid (hereinafter also "$H_2S_2O_4$") in the sulfite or sulfate process and otherwise as described in the claims.

Cellulose is known and described for example in "Ullmanns Enzyklopädie der technischen Chemie", 4th edition, volume 17, "Paper, fibrous raw materials", Verlag Chemie Weinheim, New York (1979) in chapter 1. Lignocellulosic material herein is any material, preferably natural material, which comprises lignin and cellulose.

Preferred lignocellulosic material comprises wood, including comminuted woods, such as wood cuts from saw mills.

Softwoods, preferably spruce or pine or hardwoods such as beech are very useful woods.

Lignocellulose material herein further comprehends grasses and annual plants, for example straw, reed, espartogras, bamboo and bagasse, although these are typically not digested using the sulfite process, but preferably using alkaline processes of digestion or the neutral-sulfite process.

Sulfite digestion and sulfate digestion to obtain cellulose are known and are described at the beginning and in more detail in Ullmanns Enzyklopädie der technischen Chemie, 4th edition, volume 17, "Paper, fibrous raw materials", Verlag Chemie Weinheim, New York (1979) pp. 535-549 in chapter 1.4.

Salts of dithionous acid ($H_2S_2O_4$) herein are any metal salts or substituted ($NR_4^+$) or unsubstituted ($NH_4^+$) ammonium salts of this acid.

Alkali metal salts, alkaline earth metal salts, salts of metals of group 12 of the periodic table and also ammonium ($NH_4^+$) salts are very useful salts of dithionous acid.

Preferred salts of dithionous acid are sodium dithionite ($Na_2S_2O_4$), potassium dithionite ($K_2S_2O_4$), calcium dithionite ($CaS_2O_4$), zinc dithionite ($ZnS_2O_4$), ammonium dithionite ($(NH_4)_2S_2O_4$).

Salts of dithionous acid, including the above-preferred ones, also comprise, as will be appreciated, those species which comprise water of crystallization and/or additives, the latter for stabilization for example.

The sodium dithionite product marketed by BASF SE as Blankit® or Blankit® S is a very useful salt of dithionous acid.

Any version of the sulfite process as described at the outset and in Ullmanns Enzyklopädie der technischen Chemie, 4th edition, volume 17, "Paper, fibrous raw materials", pp. 531-576, Verlag Chemie Weinheim, New York (1979) is in principle suitable for the method of the present invention.

Pulping temperature in sulfite digestion is typically in the range from 100° C. to 160° C.

The bisulfite process with $Mg(HSO_3)_2$ as a component of the cooking liquor is a very useful sulfite process of the method of the present invention and will now be more particularly described.

The lignocellulosic material used comprises softwoods, preferably sprucewoods, more preferably as chips. Chips are typically used in the forest-fresh state (i.e., with a dry matter content of about 50 wt %). The amount used is computed as oven-dry substance in order that the yield of pulp may subsequently be determined for example.

The cooking liquor can be prepared by suspending magnesium carbonate (hereinafter also "$MgCO_3$") in water and then passing $SO_2$ into the suspension, generally until the suspension has turned into a clear solution, which has a pH of about 3.8 for example. At this stage, it is typically the case that substantially the entire dissolved substance is present as $Mg(HSO_3)_2$. On continued introduction of $SO_2$, the pH would continue to decrease as the proportion of sulfurous acid increases.

Cooking the so-called lignocellulosic material with the cooking liquor takes place in the customary cookers, batchwise or else continuously. Total cooking time is in the range from 400 to 600 minutes.

A temperature profile is preferably used for cooking in the herein recited bisulfite processes, preferably the bisulfite process with $Mg(HSO_3)_2$ as a component of the cooking liquor.

A very useful temperature profile is as follows:

1st phase: heating up from a temperature in the range from 15° C. to 30° C. to a temperature in the range from 100 to 110° C., within from 60 to 120 minutes;

2nd phase (impregnating phase): 60 to 90 minutes' pausing at a temperature in the range from 100 to 110° C.;

3rd phase: heating up from a temperature in the range from 100 to 110° C. up to a temperature in the range from 150 to 160° C., within from 45 to 90 minutes;

4th phase (ready-cook time): 150 to 250 minutes' pausing at a temperature in the range from 150 to 160° C.

5th phase: cooling down to a temperature in the range from 100 to 90° C.

The salt of dithionous acid, preferably sodium dithionite ($Na_2S_2O_4$), calcium dithionite ($CaS_2O_4$), zinc dithionite ($ZnS_2O_4$), more preferably sodium dithionite, is added into the mixture of lignocellulosic material, preferably the chips of sprucewood and the cooking liquor, as described above, in an amount from 0.1 to 4.0 wt %, preferably 1.0 to 2.0 wt %, all based on the oven-dry lignocellulosic material, preferably the oven-dry chips of sprucewood.

In principle, the salt of dithionous acid can be added at any stage during the cooking process or else therebefore. The dosing regimens which follow are preferable, however:

a) at the start of the 2nd phase b) at the start of the 4th phase c) approximately halfway through the 4th phase Preferably, the salt of dithionous acid is added at the start of the 2nd phase, i.e., the impregnating phase.

A sulfate process which is very useful for the method of the present invention will now be described.

Woods, such as hard- or preferably softwoods, more preferably sprucewoods, preferably in the form of chips, are used as lignocellulosic material.

The cooking liquor used can in principle be the familiar sulfate-process mixture of aqueous sodium hydroxide solution (aqueous NaOH), sodium sulfide ($Na_2S$) and sodium sulfate (hereinafter also "$Na_2SO_4$") and optionally sodium carbonate (hereinafter also "$Na_2CO_3$"), admixed with the salt of dithionous acid, preferably selected from the group consisting of sodium dithionite, zinc dithionite and calcium dithionite, in an amount from 0.1 to 4 wt %, based on the amount of oven-dry lignocellulosic material.

A cooking liquor which is very suitable for the sulfate method of the present invention will now be described:

The cooking liquor for the sulfate process typically comprises NaOH and sodium sulfide ($Na_2S$) as active cooking chemicals. The sum total of the two substances (expressed as NaOH) relative to the lignocellulosic material, preferably wood (reckoned oven-dry), is the alkali ratio. This ratio is typically in the range from 20 to 24 wt %.

The concentration in which these substances have to be present in the cooking liquor is typically dependent on the so-called "liquor ratio". This is understood by a person skilled in the art to refer to mass fractions of cooking liquor in relation to mass fractions of lignocellulosic material, preferably wood (reckoned oven-dry). In the case of softwoods, for example spruce and pine, this liquor ratio is generally in the range from 4:1 to 4.5:1, for example 4.2:1, typically according to the fill density of wood in the cooker. Therefore, the concentration of active alkali in the cooking liquor is in the range from 45 to 60 g/l for example.

The proportion of total active alkali which is accounted for by sodium sulfide ($Na_2S$) is the sulfidity (reported in %). Sulfidity is generally in the range from 30 to 38%, for example 30%.

The cooking liquor for the sulfate method of the present invention comprises a salt of dithionous acid, preferably selected from the group consisting of sodium dithionite, zinc dithionite and calcium dithionite, in an amount from 0.1 to 4 wt % based on the amount of oven-dry lignocellulosic material.

The pH of the cooking liquor for the sulfate method of the present invention is typically about 14 at the start of the cooking process.

Cooking the lignocellulosic material with the cooking liquor for the sulfate method of the present invention takes place batchwise or continuously in customary cookers.

Total cooking time for the sulfate method of the present invention is typically in the range from 200 to 400 minutes, preferably 240 to 300 minutes.

The cooking temperature for the sulfate method of the present invention is in the range from 160 to 185° C., for example 170° C.

The salt of dithionous acid, preferably selected from the group consisting of sodium dithionite, zinc dithionite and calcium dithionite, more preferably sodium dithionite, is added in the sulfate process of the present invention to the mixture of lignocellulosic material and cooking liquor in an amount from 0.1 to 4.0 wt %, preferably 1.0 to 2.0 wt %, all based on the oven-dry lignocellulosic material.

In principle, the salt of dithionous acid can be added at any stage during the cooking process of the sulfate method according to the present invention.

The salt of dithionous acid is preferably added in the impregnating phase, the end phase of digestion or the main phase of digestion in the sulfate method of the present invention, more preferably in the end phase of digestion or in the main phase of digestion in the sulfate method of the present invention.

The method which the present invention provides for producing cellulose from lignocellulosic material by sulfite digestion or sulfate digestion delivers pulp in high yield combined with good delignification of the lignocellulosic material. There is an improvement in the brightness of the unbleached pulp.

The addition of a salt of dithionous acid in the sulfate method of the present invention reduces the concentration of malodorants preferably mercaptans in the off-gas of the sulfate cooking process.

EXAMPLES

(I) Sulfite Digestion by the Bisulfite Process with $Mg(HSO_3)_2$ as a Component of the Cooking Liquor A) Lignocellulosic Material:

Sprucewood chips presorted and predried in the ambient air for 2 to 3 days before cooking, water content ranging from 23.4 to 33.2 wt %, averaging about 30 wt %.

B) Cooking Liquor:

Arithmetically 2.7 wt % of MgO per liter. pH before cooking (initial pH) 3.8.

1100 g of $MgCO_3$ were suspended in 17 liters of deionized water to obtain an arithmetic MgO concentration of about 2.7 wt %. Gaseous sulfur dioxide ($SO_2$) was passed into the suspension until the pH was 3.8.

C) Cooking 3200 g (reckoned oven-dry) of sprucewood chips having an original water content as described in A) and 16 liters of the cooking liquor from B) were filled into the 25-liter capacity batch cooker, corresponding to a 5:1 mixing ratio for cooking liquor:oven-dry wood. The cooker was equipped with a liquor recirculator, an electrical-type jacket heater, a temperature controller, a manometer, a temperature sensor, a pH electrode, and a connected electronic data processing system.

The following heating program was implemented:

1st phase: 105 min heat-up time from room temperature (23° C.) to 105° C.

2nd phase: 90 min hold time (impregnating phase) at 105° C.

3rd phase: 60 min high-heat time from 105° C. to ready-cook temperature of 155° C.

4th phase: 195 min ready-cook time at ready-cook temperature of 155° C.

5th phase: about 60 min off-gas time (heating off on reaching cooking time) until temperature below 100° C.

Digestion time totaled 510 min (8 h 30 min). The pressure in the cooker at the end of the ready-cook time was in the range from 8 to 9 bar.

Sodium dithionite (Blankit®S from BASF SE) was added in the form of a solution in water to the mixture in the cooker within 10 min by metering pump, specifically at 32 g of pure $Na_2S_2O_4$ (1 wt % of $Na_2S_2O_4$ based on employed wood reckoned oven-dry) and/or 64 g of pure $Na_2S_2O_4$ (2 wt % of $Na_2S_2O_4$ based on employed wood reckoned oven-dry).

The times of addition for the sodium dithionite were as follows per experiment:

At the start of the holding time (impregnating phase), about 105 min after beginning the experiment or from the start of the ready-cook time, about 255 min after beginning the experiment or halfway through the ready-cook time, about 360 min after beginning the experiment.

In the case of experiment W 16, the chips were impregnated with sufficient aqueous solution of sodium dithionite (Blankit®S from BASF SE) to correspond to 1 wt % of pure $Na_2S_2O_4$ based on employed wood reckoned oven-dry, immediately prior to digestion.

On completion of the digestions, the pulp was removed, admixed with water and defiberized with a stirrer. The defiberized pulp was filled into a sieve, washed with water and dewatered in a centrifuge.

D) Inventory and Evaluation

Table 1 shows the experiments:

TABLE 1

| Experimental series | Auxiliary addition [2] | Time of addition | min [1] | Temperature at addition |
|---|---|---|---|---|
| W7 | 1% | Beginning of ready-cook time | 255 min | 155° C. |
| W8 | 1% | Start of impregnating phase | 105 min | 105° C. |
| W9 | 1% | Halfway through ready-cook time | 360 min | 155° C. |
| W10 | 2% | Start of impregnating phase | 105 min | 105° C. |
| W11 | 2% | Beginning of ready-cook time | 255 min | 155° C. |
| W12 | 1% | Start of impregnating phase | 105 min | 105° C. |
| W14 | none | — | — | — |
| W15 | 1% | Start of impregnating phase | 105 min | 105° C. |
| W16 | 1% | Before digestion process | — | — |

[1] The values denote numbers of minutes after beginning the experiment, i.e., commencement of the first heat-up
[2] sodium dithionite $Na_2S_2O_4$ The results of the experiments in table 1 are collated in table 2:

TABLE 2

| Experimental series | Auxiliary addition | Time of addition | Accepts yield [%] | kappa number/ brightness [%] | Viscosity [ml/g] |
|---|---|---|---|---|---|
| W7 | 1% | Beginning of ready-cook time | 54.2 | 24.5/60.7 | 676.1 |
| W8 | 1% | Start of impregnating phase | 54.9 | 19.0 62.9 | 640.6 |
| W9 | 1% | Halfway through ready-cook time | 55.3 | 27.9/59.1 | 689.0 |
| W10 | 2% | Start of impregnating phase | 54.5 | 25.5 59.1 | 679.8 |
| W11 | 2% | Beginning of ready-cook time | 53.1 | 17.2/63.6 | 660.8 |
| W12 | 1% | Start of impregnating phase | 54.7 | 16.0 63.3 | 645.1 |
| W14 | none | — | 55.6 | 36.1/58.6 | 708.8 |
| W15 | 1% | Start of impregnating phase | 54.3 | 20.6/61.7 | 677.4 |
| W16 | 1% | Before digestion process | 55.0 | 29.0/57.1 | 694.9 |

The following definitions apply therein:

Accepts yield is the amount of pulp obtained (without rejects/shives) as a proportion of the wood used; it was determined by weighing and dry matter content measurement.

The kappa number indicates the hardness of the pulp and was determined according to ISO 302. Put simply, the potassium permanganate consumption ($KMnO_4$ consumption) is measured to determine the kappa number in an aqueous pulp suspension in an acidic medium under defined conditions. The higher the lignin content of the pulp, the higher the potassium permanganate consumption and thus the higher the kappa number. The higher the kappa number, the higher the residual lignin content of the pulp and the harder the pulp generally is. Brightness (R457) denotes reflectance at 457 nm and was determined on an Elrepho® from Datacolor in accordance with ISO 2470.

Viscosity was determined in accordance with ISO 5351/1 (International Standard ISO 5351/1, Cellulose in dilute solutions—Determination of limiting viscosity number, Part 1: Method in cupri-ethylene-diamine (CED) solution, First edition 1981-12-01).

A solution of cellulose in copper-ethylene-diamine solution is prepared. The concentration of the solvent is a fixed value. The concentration of cellulose in the solution is decided according to the sample to be determined. What is measured is the flow time of both the solvent and the cellulose solution through a capillary viscometer at 25° C. The limiting viscosity number is computed from the results of the determination and the known concentration of the cellulose solution according to the Martin equation.

The measurement was carried out according to alternative A of the method of determination (International Standard ISO 5351/1, Cellulose in dilute solutions—Determination of limiting viscosity number, Part 1: Method in cupri-ethylene-diamine (CED) solution, First edition 1981-12-01). A low concentration is employed for the cellulose and the same capillary is used for measuring the flow times of the solvent and of the cellulose solution.

It is apparent that adding the auxiliary, particularly when it is added at the start of the impregnation phase, delivers an improved combination of accepts yield with kappa number/brightness.

(II) Sulfate Digestion

A) Lignocellulosic Material:

Mixed spruce-pine chips having a 7:3 spruce:pine mixing ratio, undried, water content 57%.

B) Cooking Liquor:

The cooking liquor was prepared from aqueous sodium hydroxide solution (NaOH) and sodium sulfide ($Na_2S$) by incorporating commercial laboratory-grade chemicals in water. The amount of chemicals used was determined such as to apply an alkali ratio of 23% coupled with a sulfidity of 20%.

C) Cooking:

Sufficient chips were introduced into a 10 l cooker to ensure that at the given dry matter content of the wood 1300 g of oven-dry wood matter were used. The cooker was filled with cooking liquor. This cooking liquor comprised 239.2 g of NaOH and 59.8 g of $Na_2S$ (reckoned as NaOH) for a desired alkali ratio of 23% and a sulfidity of 20%. The cooker contents were then heated to 170° C. and maintained at 170° C. until the desired digestion time was reached.

The so-called H-factor was used to calculate the desired digestion time. The calculation was made on the basis of the temperature dependence of the relative reaction rate for the alkaline digestion. An H-factor of 3500 was realized for all cookings.

In the case of selected cookings, 2 wt % of sodium dithionite were added in each case relative to the introduced quantity of wood (reckoned oven-dry). The time of addition was during the main phase of digestion in one cooking and during the end phase of digestion in a further cooking. On reaching the H-factor of 3500, the cookings were discontinued by ending the heating and cooling down in conjunction with depressurization ("off-gassing"). The pulp was defiberized by vigorous stirring and washed.

D) Inventory and Evaluation

Table 3 presents the experiments:

TABLE 3

| Cooking No. | Auxiliary addition [1] | Time of addition | Temperature at addition |
|---|---|---|---|
| 1 | none | — | — |
| 2 | 2% | main phase | 170° C. |
| 3 | 2% | end phase | 170° C. |

[1] Sodium dithionite $Na_2S_2O_4$

Table 4 presents the accepts yield and the kappa number.

TABLE 4

| Cooking No. | Auxiliary addition [1] | Accepts yield % | Kappa number |
|---|---|---|---|
| 1 | none | 43.3 | 20.1 |
| 2 | 2% in main phase | 46.4 | 19.4 |
| 3 | 2% in end phase | 47.1 | 19.9 |

[1] sodium dithionite $Na_2S_2O_4$

Accepts yield and kappa number are as defined under (I), above.

It is apparent that adding the sodium dithionite is associated with a distinct increase in yield (by 3 to 4 percentage points) and even a slight reduction in the kappa number.

E) Reduction of Methyl Mercaptan Emissions

A sulfate digestion of softwood was carried out as described above.

During the release of gases from the cooker ("off-gassing"), off-gas samples were taken at different times using a detection pump. The concentration of methyl mercaptan in these samples was measured using gas testing tubes specific to methyl mercaptan.

The first measurement in each case was carried out immediately after terminating cooking; the temperature in the cooker was 172° C. Subsequent measurements were carried out at further decreased cooker temperatures, see table 5. The results are complied in table 5.

TABLE 5

Methyl mercaptan concentrations

| Test | wt % [1] of $Na_2S_2O_4$ | Sulfidity [%] | Cooker temperature at time of measurement [° C.] | Methyl mercaptan-concentration [ppm] |
|---|---|---|---|---|
| 1b | 0 | 30 | 162 | 890 |
| 2b | 0 | 20 | 162 | 410 |
| 3b | 2 | 30 | 162 | 400 |
| 4b | 2 | 20 | 162 | 180 |

[1]: based on oven-dry wood

Sulfidity is: $Na_2S$ fraction in active alkali

The methyl mercaptan concentration is highest at high sulfidity. Using $Na_2S_2O_4$ results in a decrease of the methyl mercaptan in the off-gas.

We claim:

1. A method of producing cellulose from lignocellulosic material by sulfite digestion or sulfate digestion in the presence of a salt of dithionous acid, which method comprises using the salt of dithionous acid in an amount from 0.1 to 4.0 wt. % where the digestion is a sulfite digestion and in an amount from 1.0 to 2.0 wt. % where the digestion is a sulfate digestion, each amount respectively based on the amount of oven-dry lignocellulosic material, wherein the salt of dithionous acid is added in said sulfite digestion as soon as the mixture of cooking liquor and lignocellulosic material to be digested has attained a temperature in the range from 60° C. to 110° C. in the course of being heated up, and the mixture thus obtained is left at a temperature from 100° C. to 110° C. for from 30 to 90 minutes (impregnation phase), and wherein the salt of dithionous acid is added in said sulfate digestion in the end phase of digestion.

2. The method according to claim 1 wherein the salt of dithionous acid is selected from the group consisting of sodium dithionite, zinc dithionite and calcium dithionite.

3. The method according to claim 1 wherein the salt of dithionous acid is sodium dithionite.

4. The method according to claim 1 wherein said sulfite digestion is conducted in the temperature range from 100° C. to 160° C. and said sulfate digestion is conducted in the temperature range from 160° C. to 185° C.

5. The method according to claim 1 wherein the lignocellulosic material is wood.

6. The method according to claim 1 as a batch operation.

* * * * *